US011304278B2

(12) United States Patent
Hoffmann

(10) Patent No.: US 11,304,278 B2
(45) Date of Patent: Apr. 12, 2022

(54) METHOD AND SYSTEM CONFIGURATION FOR SETTING A CONSTANT WAVELENGTH

(71) Applicant: Inova Semiconductors GmbH, Munich (DE)

(72) Inventor: Stefan Hoffmann, Munich (DE)

(73) Assignee: Inova Semiconductors GmbH, Munich (DE)

( * ) Notice: Subject to any disclaimer, the term of this patent is extended or adjusted under 35 U.S.C. 154(b) by 0 days.

(21) Appl. No.: 15/733,601

(22) PCT Filed: Apr. 1, 2019

(86) PCT No.: PCT/EP2019/000106
§ 371 (c)(1),
(2) Date: Sep. 11, 2020

(87) PCT Pub. No.: WO2019/238260
PCT Pub. Date: Dec. 19, 2019

(65) Prior Publication Data

US 2021/0368601 A1 Nov. 25, 2021

(30) Foreign Application Priority Data

Jun. 15, 2018 (DE) ..... 10 2018 004 826.9

(51) Int. Cl.
*H05B 45/20* (2020.01)
*H05B 45/28* (2020.01)
*H05B 45/325* (2020.01)

(52) U.S. Cl.
CPC ..... *H05B 45/28* (2020.01); *H05B 45/325* (2020.01)

(58) Field of Classification Search
CPC ..... H05B 45/18; H05B 45/28; H05B 45/56; H05B 45/345; H05B 45/355; H05B 47/11; H05B 47/155; H05B 47/165
See application file for complete search history.

(56) References Cited

U.S. PATENT DOCUMENTS 6,411,046 B1 * 6/2002 Muthu ..... H05B 45/20 315/309
9,380,661 B2 * 6/2016 Takahashi ..... H05B 45/3725
(Continued)

FOREIGN PATENT DOCUMENTS

EP 2273851 A2 1/2011
WO WO-2014067830 A1 5/2014
(Continued)

OTHER PUBLICATIONS

"International Application No. PCT/EP2019/000106, International Search Report and Written Opinion dated Jun. 25, 2019", (Jun. 25, 2019), 12 pgs.

*Primary Examiner* — Tung X Le
(74) *Attorney, Agent, or Firm* — Schwegman Lundberg & Woessner, P.A.

(57) ABSTRACT

The present invention relates to a method which makes it possible, with low technical outlay, to set a constant wavelength in an LED in such a way that, for a human observer using the naked eye, a constant colour of the LED is set. The present invention further relates to a correspondingly set-up system arrangement and to a computer program product comprising control commands which carry out the method or operate the system arrangement.

13 Claims, 5 Drawing Sheets

(56) References Cited

U.S. PATENT DOCUMENTS

| | | | | |
|---|---|---|---|---|
| 2008/0203945 | A1* | 8/2008 | Deurenberg | H05B 45/28 315/307 |
| 2008/0246419 | A1* | 10/2008 | Deurenberg | H05B 45/28 315/309 |
| 2010/0301777 | A1* | 12/2010 | Kraemer | H05B 45/325 315/312 |
| 2013/0293147 | A1* | 11/2013 | Rogers | H05B 45/20 315/297 |
| 2014/0084813 | A1* | 3/2014 | Takahashi | H05B 45/382 315/307 |
| 2015/0002023 | A1 | 1/2015 | Imangholi et al. | |

FOREIGN PATENT DOCUMENTS

| | | | |
|---|---|---|---|
| WO | WO-2017153026 | A1 | 9/2017 |
| WO | WO-2017162323 | | 9/2017 |
| WO | WO-2017162324 | A1 | 9/2017 |
| WO | WO-2019238260 | A1 | 12/2019 |

* cited by examiner

300

METHOD AND SYSTEM CONFIGURATION FOR SETTING A CONSTANT WAVELENGTH

PRIORITY CLAIM TO RELATED APPLICATIONS

This application is a U.S. national stage filing under 35 U.S.C. § 371 from International Application No. PCT/EP2019/000106, filed on 1 Apr. 2019, and published as WO2019/238260 on 19 Dec. 2019, which claims the benefit under 35 U.S.C. 119 to German Application No. 10 2018 004 826.9, filed on 15 Jun. 2018, the benefit of priority of each of which is claimed herein, and which applications and publication are hereby incorporated herein by reference in their entirety.

The present invention relates to a method which makes it possible, with low technical outlay, to set a constant wavelength in an LED in such a way that, for a human observer using the naked eye, a constant colour of the LED is set. The present invention further relates to a correspondingly set-up system arrangement and to a computer program product comprising control commands which carry out the method or operate the system arrangement.

EP 2273851 A2 shows a control system for controlling a lighting arrangement.

US 2015/0002023 A1 shows a light diode arrangement with several light diodes.

WO 2014/067830 A1 shows a method and arrangement for error correction in light diodes.

WO 2017/162 323 A1 discloses an efficient control arrangement and a control method which make it possible to provide particularly efficient data transmission, in particular for LED control units. The specification also relates to a corresponding protocol which causes control units to carry out the corresponding method steps.

WP 2017/162 324 A1 discloses a method and a device for bidirectional communication between a command unit and a plurality of LED control units connected thereto. This makes it possible to send control commands at high speed to a plurality of LED control units connected in series or to return performance results from these control units to a command unit.

WO 2017/153 026 A1 discloses a method and a device for brightness compensation of an LED, a constant brightness of the LED always being achieved irrespective of the temperature fluctuation.

Known methods provide pulse-width modulation, which makes use of the fact that there is an inertia of the components used, in such a way that a uniform brightness is set even if the LED is switched on and off in a particular proportion. In this case, the brightness is set as a function of the ratio of the on state to the off state. This type of pulsation of the LED is typically not perceived by the human eye, and this actuation results in a uniform settable brightness.

It is further possible to integrate a pulse generator into the constant power source circuit, the supply voltage remaining constant and the clock cycle of the lamps being provided using the power source itself, which is run in pulse operation. For this purpose, actuation circuits are known which regulate the LEDs to a settable target value, the target value being settable by a controller. LEDs are dimmed directly by known methods, by dimming the current through the LEDs. Control logics for additionally regulating the current supply to the LED as a function of the temperature of the LED are also known.

LEDs are used in many application scenarios in which they should at least not be disadvantageous by comparison with light bulbs. Whilst it is simple to dim the brightness of light bulbs, for LEDs methods are known which actuate these LEDs, for example using a predetermined actuation pattern, and thus make optical dimming possible. By contrast, however, it is often desirable for an LED also to have to be set brighter for example in the event of a rising ambient temperature. This is because LEDs typically have illumination properties which reduce the emitted luminosity as a function of a rising temperature.

In general, it is known for LEDs, which are typically provided as red-, green- or blue-emitting LEDs, to be susceptible to brightness or colour fluctuations in relation to temperature development. Thus, in the prior art, it is disadvantageous that the colour variations as a function of the temperature development or the brightness variations may end up being strong enough to be detectable to the human eye and thus result in undesired optical effects. These optical effects may relate to comfort functions, for example of a vehicle, where application scenarios also provide that the LEDs perform a safety function. Thus, LEDs are also used as optical warning signal generators, and the drawback of the brightness variation or colour variation may be safety-critical.

Proceeding from the prior art, the technical outlay which has to be provided in the production of LEDs is particularly problematic. Thus, LEDs of this type have to undergo tests, resulting in an increased rejection rate when the LEDs cannot achieve predetermined target values as a function of the temperature. This state of affairs is particularly disadvantageous in the usage scenario of automobiles. A particular drawback occurs here, namely the fact that the installed LEDs cannot be replaced at any time, and instead the end customer has to send his vehicle in for repair. Aside from the high logistical outlay to be met, in the prior art this drawback reduces the end customer's acceptance of optical devices of this type.

Therefore, an object of the present invention is to propose an improved method for setting a constant wavelength of an LED, which makes it possible for as constant a colour as possible to be set in the LED without this requiring major technical outlay. Further, an object of the present invention is to propose a correspondingly set-up system arrangement and a computer program product comprising control commands which carry out the method or operate the system arrangement.

The object is achieved by the features of claim 1. Further advantageous embodiments are set out in the dependent claims.

Accordingly, a method for setting a constant wavelength of an LED is proposed, comprising actuating the LED using a pre-set current, measuring an actual temperature of a control unit arranged in the direct vicinity of the actuated LED, providing an empirically determined wavelength variation of the LED as a function of the temperature of the LED, and adapting the pre-set current as a function of the actual temperature and the empirically determined wavelength variation to set the constant wavelength of the LED.

In this context, a person skilled in the art will appreciate that individual method steps can be carried out iteratively and/or in a different order. In particular, method steps may have different sub-steps. Thus, typically, the LED is actuated iteratively, and the temperature at the control unit is measured iteratively. In a preparatory method step, an empirically determined wavelength variation is provided. The pre-set current is adapted in a particular clock cycle or within pre-set intervals.

By means of the proposed method, it is achieved that a constant wavelength of an LED is set, since the error rate of the LEDs is detected and the current is thus set accordingly. The constant wavelength is a substantially constant wavelength, the reference point for the constant wavelength being the human eye. Thus, it is actually technically possible according to the proposed method that the wavelength is not constant but is adapted in such a way that it is constant for the naked human eye. Thus, by way of the constant wavelength, a colour value which is constant to a human observer is set. Using technical tools, however, it can be detected that the constant wavelength is merely a substantially constant wavelength which varies slightly.

An LED may take the form of a red-, green-, blue- or white-glowing or emitting LED. In this context, it is known to combine these different individual LEDs into LED units, in such a way that, depending on the construction, for example three or four individual LEDs form an LED unit. In this context, further technical devices may be provided, which for example actuate the individual LEDs in such a way that one wavelength or one brightness occurs.

This is provided by the proposed control units, which apply a particular current to the LEDs indirectly or perform a pulse-width modulation. By means of the pulse-width modulation, the brightness or luminosity of each individual LED is set, and the wavelength is thus set as a function of the current. The proposed current is thus the current with which the LED is actuated. This is not inconsistent with no current being provided at least at times during the pulse-width modulation.

This current is provided using a pre-set current during the actuation of the LED. This generally involves operation of the LED in accordance with a provided specification. This method step also takes place in the prior art, resulting in the drawback that the constant pre-set current leads to wavelength variation, which is visible to the observer in that the colour of the LED changes. This takes place as a result of the changing temperature relationships within the LED. The pre-set current is typically stored in a storage unit of the LED or is provided by the control unit.

In a further method step, an actual temperature of a control unit arranged in the direct vicinity of the actuated LED is measured. Thus, according to the invention, it is recognised that the temperature need not be measured directly at the LED, but rather the control unit may be used for this purpose. According to the invention, this results in a construction which makes it possible for the temperature to be measurable at an alternative point, and for the measurement sensor or temperature sensor to be arrangeable at the control unit in this context. Since the temperature is not measured directly at the LED, but rather at the control unit, in one aspect the proposed method takes this distance into account and varies the current accordingly. Since the control unit is arranged in the direct vicinity of the LED, a conclusion can be drawn as to the temperature of the LED during operation.

In this context, a direct vicinity means a substantially direct vicinity such that merely one layer, for example such as is described below, is arranged between the measurement sensor and the control unit. Thus, "direct" means that no further active components are installed. Thus, merely passive components, such as connecting layers or thermal conduction layers, are arranged between the LED and the control unit. In general, the feature "direct" vicinity is optional as long as no further active, heat-generating units are arranged between the LED and the control unit. Thus, the method step may also be carried out in such a way that an actual temperature of a control unit arranged in the vicinity of the actuated LED is measured. In particular, distances of less than one millimetre are still considered direct.

Thus, an empirically determined wavelength variation of the LED as a function of the temperature of the LED is provided. This is also referred to as providing a characteristic of the LED. The empirically determined wavelength variation specifies to what extent the wavelength of the LED changes with rising or falling temperature. This is also referred to as the error rate of the LED, and specifies a technically conditioned value corresponding to a delta of the wavelength value which occurs when the temperature of the LED rises or falls. This empirical value can be stored in a data store.

Since the length variation is now known, and a temperature is also known from which a conclusion as to the temperature of the LED can be reached, the pre-set current is adapted. Thus, the method branches iteratively back to a first method step which provides actuating the LED. In this context, the LED is actuated in such a way that the constant wavelength or the substantially constant wavelength of the LED is set.

Thus, in this method step, the wavelength variation is compensated by way of the temperature, and the current is set in such a way that an always constant colour value of the LED occurs.

In general, according to the invention it can be taken into account that the actual temperature is measured at the control unit and not at the LED, and the provided empirically determined wavelength variation relates to a temperature of the LED. It is thus advantageous to include a compensation factor here, which takes into account the fact that the measurement is not actually taken directly at the LED, but rather at the arranged control unit. As a result, according to the invention it is possible to propose an alternative construction and also to operate the method accordingly.

In a final method step to be carried out iteratively, in the context of adapting the pre-set current, the LED is actually actuated by way of this adapted current. Thus, over time or over the temperature development, it is ensured that the LED emits a constant wavelength.

In one aspect of the present invention, the method is carried out for each of a red-, blue-, green- and white-emitting LED. This has the advantage that, using the proposed method, not only can be colours be set, but the luminosity can also be adapted using a white-emitting LED, in such a way that no separate method need be used for brightness compensation. Thus, the brightness of the LED can also be controlled with low technical outlay.

In a further aspect of the present invention, the method is carried out iteratively in such a way that the pre-set current is adapted substantially every 2 seconds. This has the advantage that the wavelength is always actually adapted, but a low computational outlay is required and thus the underlying components can also be configured efficiently. According to the invention, it has been recognised that adapting the current every two seconds is advantageous in relation to human perception in that no significant error, i.e. deviation of the actual wavelength from the target wavelength, occurs in a time interval of this type, and thus merely negligible error rates occur. It is thus ensured that the human eye does not establish any deviation in the wavelength and thus perceives a constant wavelength overall. Merely technically, it can be established using tools that within the 2 seconds the wavelength varies, and this is thus adapted promptly. Thus, according to the invention, a suitable balance between hardware outlay and human perception is created.

In a further aspect of the present invention, the pre-set current specifies a current pulse of a pulse-width modulation. This has the advantage that the pre-set current can be switched on and off in the context of the pulse-width modulation, in such a way that the brightness can also be varied. Thus, in the context of actuating the LED using a pre-set current, it is also possible to apply no current temporarily and thus to implement the pulse-width modulation.

In one further aspect of the present invention, the pre-set current is adapted using a stored error function. This has the advantage that a function can be empirically determined which multiplies or adds the inverse of the wavelength error into or onto the current, in such a way that the resulting error, in other words the deviation in the wavelength, is cancelled out or compensated. The error function thus determines a value by which the pre-set current has to be adapted in such a way that the initial wavelength is created again.

In a further aspect of the present invention, the error function provides a compensation value which evens out the wavelength variation of the LED. This has the advantage that, as a function of an actual temperature, a delta for the current is created, and this delta is taken from the pre-set current in such a way that the desired constant wavelength is set.

In a further aspect of the present invention, the compensation value takes the form of a compensation factor and/or compensation summand. This has the advantage that a compensation value can be multiplied in and/or added on, a combination of both options being proposed according to the invention. Thus, the current can at any time be adapted in such a way that the desired constant wavelength is set or the error in the deviation of the wavelength is compensated.

In a further aspect of the present invention, the error function determines the temperature of the LED as a function of the actual temperature of the control unit. This has the advantage that the temperature does not have to be taken directly at the LED, but rather according to the invention the temperature is measured at the control unit and thus a conclusion is drawn as to the temperature of the LED. As a result, an alternative construction can be implemented and experimental values can be drawn on which specify which temperatures are present at the LED for what temperatures at the control unit. Further, from the temperature, conclusions can be drawn as to the wavelength, meaning in turn that the current can be adapted in such a way that in turn the desired wavelength is set. This is because the wavelength varies with the temperature for technical reasons.

In a further aspect of the present invention, the pre-set current is adapted when an actual wavelength deviates from the target wavelength by more than a threshold. This has the advantage that not every deviation in wavelength has to be corrected immediately, but rather a threshold can be defined, which corresponds for example to the precision of the naked human eye. If this threshold is exceeded or undershot, the current is adapting, and the underlying hardware components can be configured particularly efficiently. This is because not every deviation needs to be compensated immediately, but rather the threshold can be selected sufficiently large that the variation is not actually visible to the human eye. In this regard, the threshold may also take into account the underlying hardware, and this can in turn be configured efficiently.

In a further aspect of the present invention, the empirically determined wavelength variation specifies a characteristic of the LED. This has the advantage that a technical specification, also known as a characteristic, can be supplied in advance by the manufacturer. The characteristic describes features of the LED, and thus a wavelength variation as a function of temperature can also be provided and is thus corrected according to the invention.

In a further aspect of the present invention, the direct vicinity is less than 1 mm. This has the advantage that the underlying unit is selected sufficiently small that it is actually still possible to refer to a direct vicinity, although according to the invention it has been found that larger deviations are complex to calculate. Thus, a vicinity of less than 1 mm does not typically lead to a major distortion of the temperature, and the method according to the invention can be based on the temperature of the control unit rather than the temperature of the LED.

In a further aspect of the present invention, the direct vicinity is set using the thickness of an adhesive layer, a silicone layer, a polymer layer, a thermal conduction layer, an aluminium layer and/or a copper layer. Further, an air gap or casting resins may be used for this purpose. This has the advantage that the distance between the LED and the control unit, or alternatively the distance between the measurement sensor and the control unit, can be set in such a way that at least one of the cited layers is used. This is generally a direct vicinity, since no electronic components are arranged between the proposed nominal units, and thus no new heat source is created either. Thus, according to the invention, reference is made to a direct vicinity in spite of a layer being introduced. According to the invention, the current is adapted while taking into account a layer of this type, and thus compensates the fact that according to the invention the temperature is measured at the control unit and not at the LED.

In a further aspect of the present invention, the control unit is provided as a controller, controller chip, logic circuit, logic gate or microcontroller. This has the advantage that efficient computation units can be used as control units which actuate the LED or LEDs. By means of a control unit of his type, the LED can be actuated by pulse-width modulation, and in particular, according to the invention, the LED is actuated using a pre-set current, which can be regulated for example by the control unit.

The object is also achieved by a system arrangement for setting a constant wavelength of an LED, having a control unit set up to actuate the LED using a pre-set current, at least one measurement sensor set up to measure an actual temperature of the control unit arranged in the direct vicinity of the actuated LED, an interface unit set up to provide an empirically determined wavelength variation of the LED as a function of the temperature of the LED, and a compensation interface set up to adapt the pre-set current as a function of the actual temperature and the empirically determined wavelength variation to set the constant wavelength of the LED.

The object is also achieved by a computer program product comprising control commands which carry out the proposed method or operate the proposed system arrangement.

According to the invention, it is particularly advantageous for the method to be set up to operate the proposed system arrangement and for the system arrangement to be set up to carry out the proposed method. The method thus comprises method steps which can be functionally reflected by the structural features of the system arrangement. Moreover, the system arrangement comprises functional components which provide a functionality in accordance with the proposed method steps. The computer program product serves both to carry out the method steps and to operate the system arrangement.

Further advantageous aspects are described in greater detail with reference to the accompanying drawings, in which.

Figure 1:
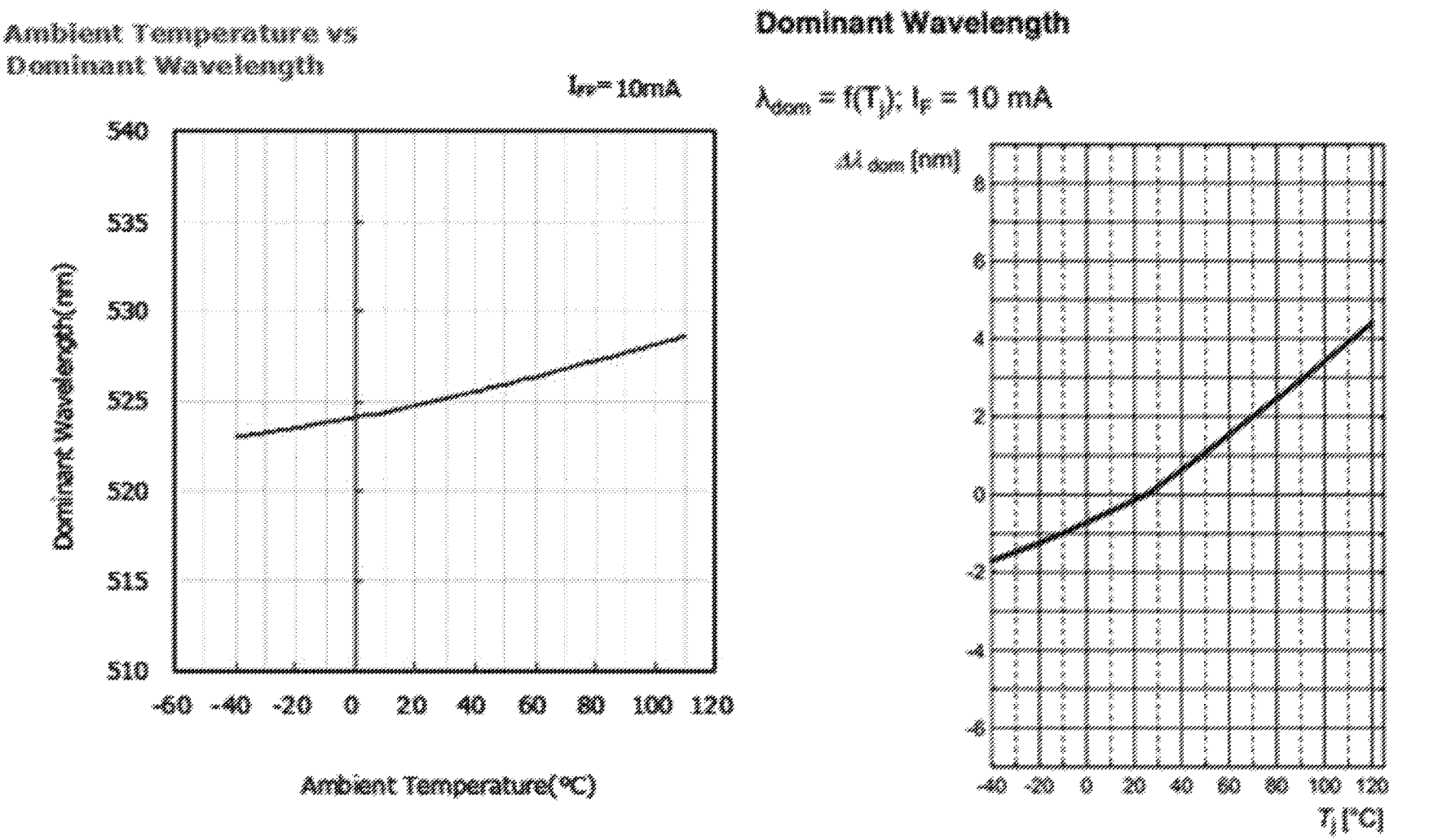
FIG. 1 shows a development of a wavelength of an LED as a function of the temperature as a starting point for the present invention.

The left side of FIG. 1 is a graph in which the temperature of the LED is plotted on the x-axis and the resulting wavelength emitted by the LED is plotted on the y-axis. Typically, a constant wavelength is required, but it disadvantageously varies with the temperature. As is shown in the present graph, the wavelength increases with rising temperature, resulting in the observer perceiving a colour variation which is not desired. An analogous example is shown on the right side for a particular value. The present invention tackles the object of compensating this variation in the wavelength.

Figure 2:
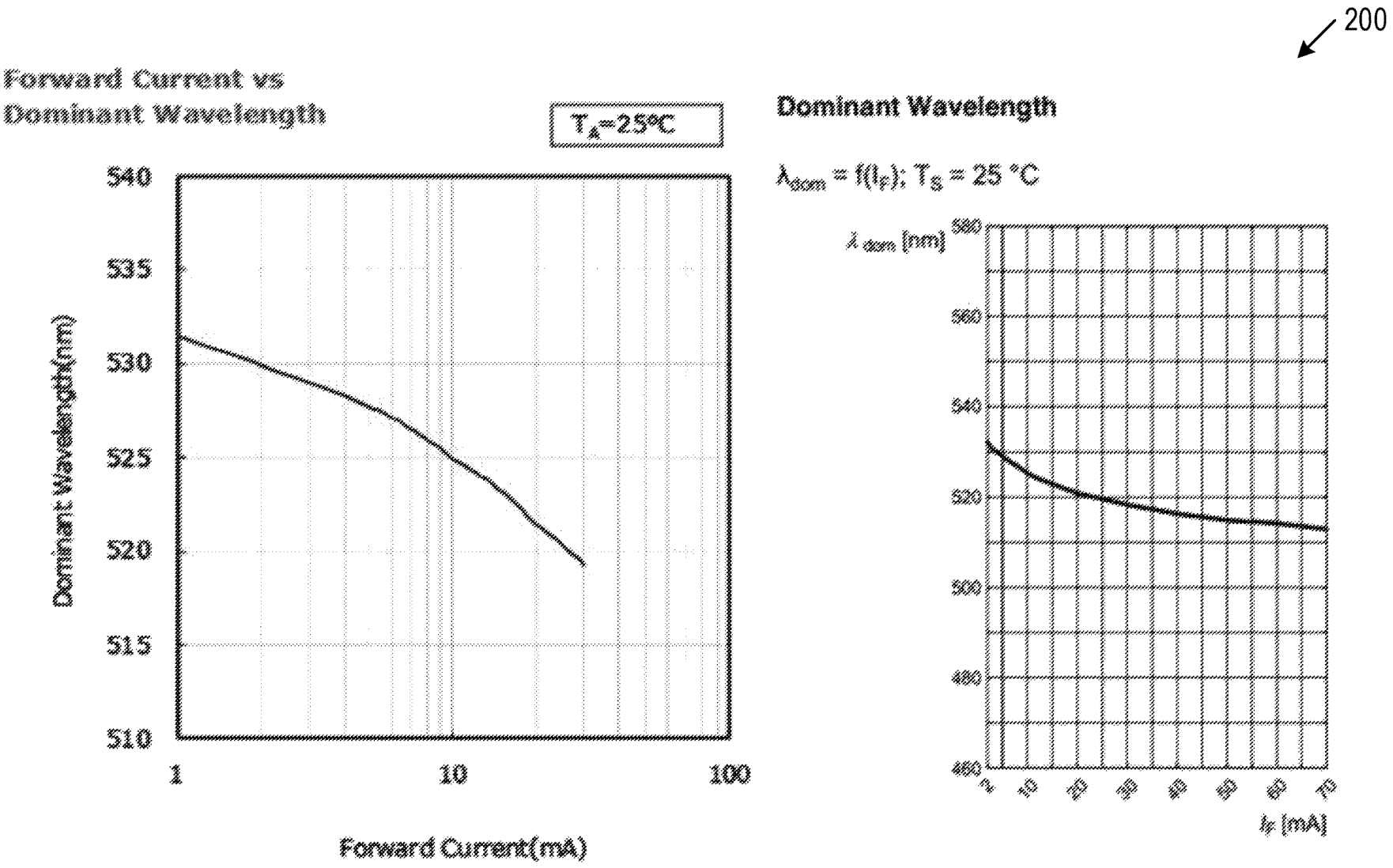
FIG. 2 shows a development of a wavelength of an LED as a function of a set current as a further starting point for the present invention.

The left graph of FIG. 2 shows a current, plotted on the x-axis, and a wavelength, plotted on the y-axis. As can be seen here, the wavelength varies as a function of the supplied current and the wavelength is thus reduced with increasing current. A characteristic curve development is likewise shown on the right side, the wavelength again being plotted on the y-axis and the current on the x-axis.

According to the invention, the drawbacks whereby the wavelength varies as a function of the temperature developments are overcome, while making use of the fact that the wavelength can also be altered by way of the provided current.

Figure 3:
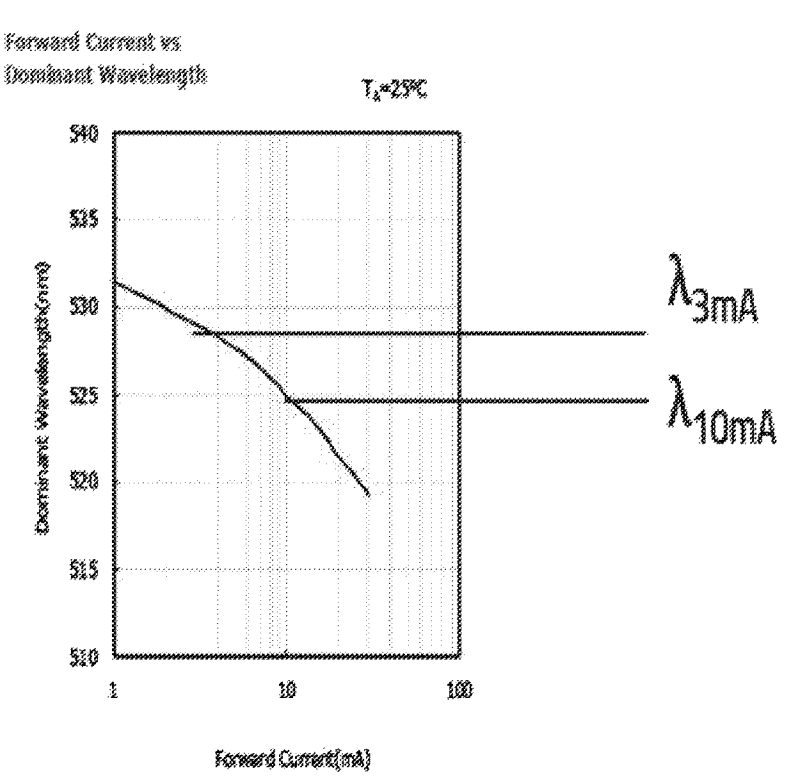
FIG. 3 shows compensation of a wavelength in accordance with an aspect of the present invention.
Figure 3:
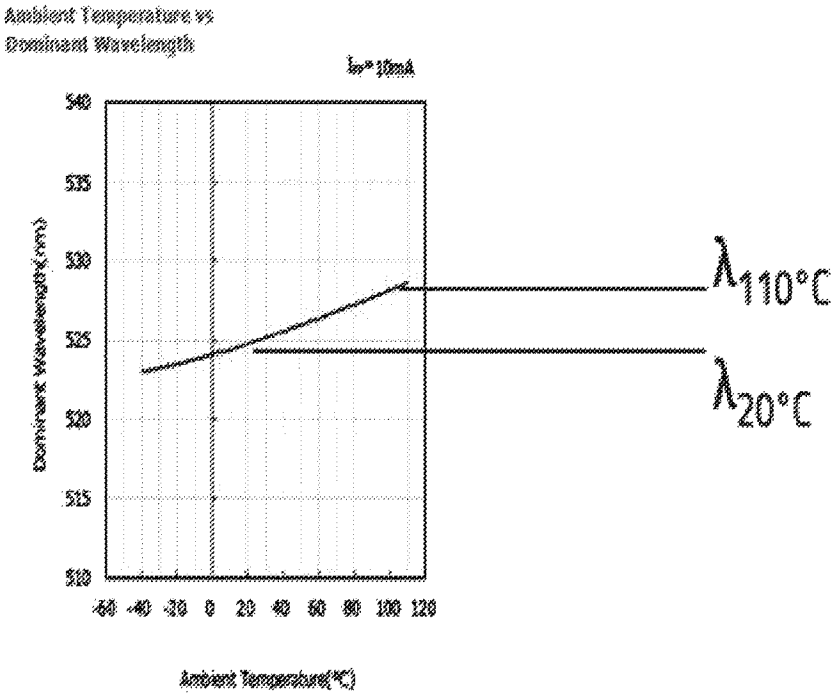

FIG. 3 shows an aspect of the present invention, specifically that it can be determined what wavelength is present at what temperature, and in addition it can also be calculated how a corresponding error function is to be configured. Thus, for example, values of 20° C. and 110° C. are taken into account.

The right side shows a corresponding graph, which again plots the supplied current on the x-axis and the wavelength on the y-axis. According to the invention, these two graphs of FIG. 3 are now combined, and the increasing wavelength on the left side as a function of temperature is eliminated by way of the falling wavelength on the right side as a function of the supplied current.

Thus, according to the invention, the two graphs are combined, and the current is increased with rising temperature. Thus, the wavelength rises with the temperature, and according to the invention this is compensated in that the error function increases the set current in such a way that, in accordance with the increase on the left side, a reduction in the wavelength according to the right side occurs. A constant wavelength, which is produced according to the invention, is thus superposed on the two curves.

As a result, according to the invention, the current is set as a function of the actual temperature or of the wavelength variation. This method can be carried out iteratively, in such a way that the graphs are created for each of the LEDs, i.e. the red, green, blue and white LEDs.

Figure 4:
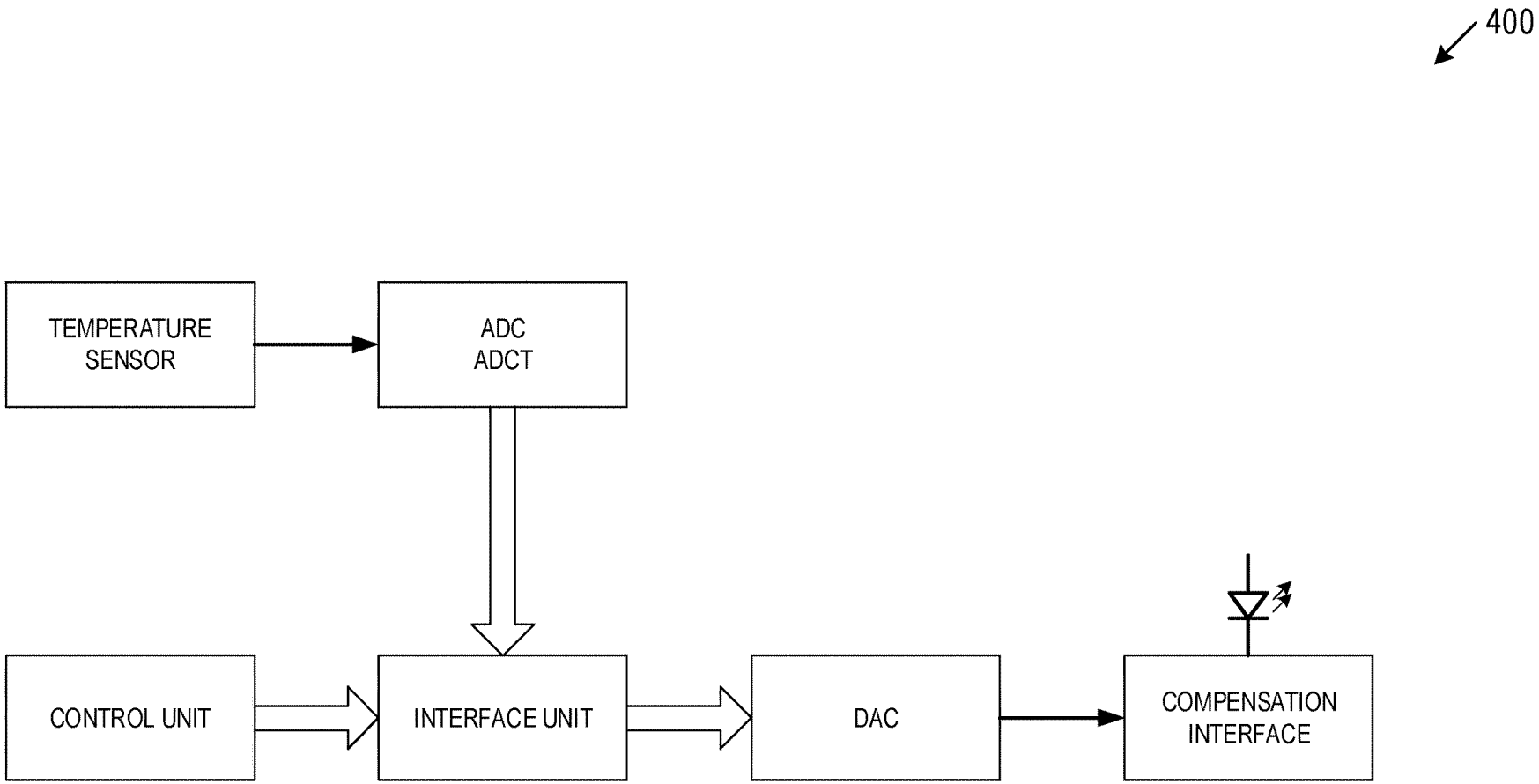
FIG. 4 shows a system arrangement in accordance with a further aspect of the present invention.

FIG. 4 shows the proposed system arrangement, a temperature sensor being arranged at top left, which measures the temperature at the control unit or in the direct vicinity of the LED and then conveys the measure value in analogue to an analogue-digital converter. This component then supplies the digital measured value to the error function component. On the left side, a one-time-programmable module is arranged, i.e. a nonvolatile memory, referred to as an OTP for short. The error function component then sends the value to be set to a digital-analogue convertor, which thus addresses the LED.

Figure 5:
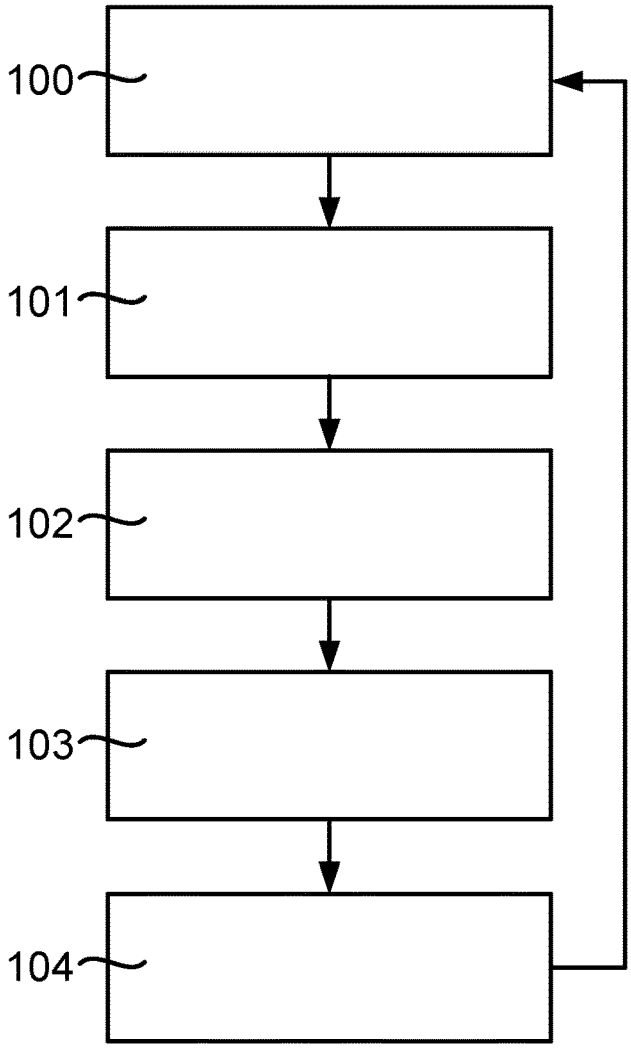
FIG. 5 is a schematic flow chart of the proposed method for setting a constant wavelength in accordance with the present invention.

FIG. 5 is a schematic flow chart of the proposed method for setting a constant wavelength of an LED, comprising actuating 100 the LED using a pre-set current, measuring 101 an actual temperature of a control unit arranged in the direct vicinity of the actuated 100 LED, providing 102 an empirically determined wavelength variation of the LED as a function of the temperature of the LED, and adapting 103 the pre-set current as a function of the actual temperature and the empirically determined wavelength variation to set 104 the constant wavelength of the LED.

In one aspect of the present invention, at least one sensor for measuring the temperature is provided at at least one measurement site. A plurality of measurement sites are suitable for this purpose, for example a measurement site at exactly one LED, a measurement site at each LED, a measurement site at a microcontroller which is connected to an LED, or a measurement site in a direct neighbourhood of an LED. For example, the proposed method may be used for a plurality of connected LEDs. In this context, it is possible for example for a plurality of LEDs to be connected in series. If this plurality of LEDs are installed in an automobile, it may happen that there are different temperatures at different usage sites. Thus, the LEDs may not merely be heated by their own operation, but rather temperature may be radiated out from adjacent components. Thus, according to the invention, it is possible to take this into account and to determine a temperature at a plurality of measurement sites. In this context, a direct neighbourhood refers to a neighbourhood which makes it possible to draw a conclusion as to the temperature of the LED. Thus, this temperature need not be establishable directly at the LED, but rather a temperature sensor may be spaced apart from the LED in such a way that a temperature input from adjacent components is negligible. In particular, this means that no physical contact, in the sense of the temperature sensor and LED touching, need be present.

In a further aspect of the present invention, the LED takes the form of a triple of three LED units and the LED units each emit a different colour. According to the invention, individual LEDs are also possible. This has the advantage that coloured LEDs can be used. In particular, according to the invention, it is possible to continue to use conventional LEDs and merely to actuate the current regulator of these same LEDs in such a way that the advantage according to the invention occurs. Further, the proposed method has the advantage that the brightness compensation can occur independently of the colour setting of the LED. In this context, further LEDs are known to a person skilled in the art which have LED units which can be reused according to the invention. For example, an LED unit takes the form of a semiconductor module or of any light-emitting component.

Emission of different colours, or light of different wavelengths, is used to set a predetermined colour value.

In a further aspect of the present invention, a storage module provides a plurality of temperature values, to each of which a current is assigned. This has the advantage that a plurality of temperature values can be taken into account, and the temperature values can be predetermined in relation to the currents in such a way that the same brightness value of the LED is always set. In particular, the number of current/temperature pairs can be determined in a preparatory method step.

Accordingly, the storage module or the storage of the currents is to be interpreted in such a way that any type of storage module or storage is possible. Thus, the storage module need not be set up dynamically in such a way that it has to be writable during operation, i.e. during actuation of the current regulator. Rather, storage merely requires the corresponding information to be introduced to a hardware module in some manner. It may also be necessary not to provide a single storage module, but rather to provide further components for this purpose which make it possible to provide the current.

Preferably, an LED may be understood to be a device which may also comprise further LED chips. Thus, the LEDs according to the invention in turn consist of further LED units or semiconductor chips. For this purpose, for example the known red, green and blue LED units may be used, which are set in terms of the RGB colour space. These individual LED units are combined in an LED housing in such a way that the light thereof combines to form a predetermined colour value. Thus, for example, it is possible to set a mixing ratio in such a way that the LED as a whole emits a white light. Further devices may also be provided for this purpose, such as a diffusor. For a combination of individual LEDs or LED units, any desired coloured light can still be set by suitable actuation of the individual components. Thus, for example, colour transitions can also be produced. According to the invention, for example, multi-LED components may be used.

The invention claimed is:

1. A method for setting a constant wavelength of an LED, the method comprising:

actuating the LED using a pre-set current;

measuring an actual temperature of a control unit arranged in the direct vicinity of the actuated LED, wherein merely passive components are arranged between the LED and the control unit;

providing an empirically determined wavelength variation of the LED as a function of a temperature of the LED; and adapting the pre-set current as a function of the actual temperature and the empirically determined wavelength variation to set (104) the constant wavelength of the LED, wherein the pre-set current is adapted using a stored error function and the error function determines the temperature of the LED as a function of the actual temperature of the control unit.

2. The method according to claim 1, wherein the method is carried out for each of a red-, blue-, green- and white-emitting LED.

3. The method according to claim 1, wherein the method is carried out iteratively in such a way that the pre-set current is adapted substantially every two seconds.

4. The method according to claim 1, wherein the pre-set current specifies a current pulse of a pulse-width modulation.

5. The method according to claim 1, wherein the error function provides a compensation value which evens out the wavelength variation of the LED.

6. The method according to claim 5, wherein the compensation value takes the form of a compensation factor and/or compensation summand.

7. The method according to claim 1, wherein the pre-set current is adapted when an actual wavelength deviates from the target wavelength by more than a threshold.

8. The method according to claim 1, wherein the empirically determined wavelength variation specifies a characteristic of the LED.

9. The method according to claim 1, wherein the direct vicinity is less than one millimetre.

10. The method according to claim 1, wherein the direct vicinity is set using the thickness of an adhesive layer, a silicone layer, a polymer layer, a thermal conduction layer, an aluminium layer and/or a copper layer.

11. The method according to claim 1, wherein the control unit is provided as a controller, controller chip, logic circuit, logic gate or microcontroller.

12. A system arrangement for setting a constant wavelength of an LED, comprising:

a control unit set up to actuate the LED using a pre-set current;

at least one measurement sensor set up to measure an actual temperature of the control unit arranged in the direct vicinity of the actuated LED, wherein merely passive components are arranged between the LED and the control unit;

an interface unit set up to provide an empirically determined wavelength variation of the LED as a function of a temperature of the LED; and a compensation interface set up to adapt the pre-set current as a function of the actual temperature and the empirically determined wavelength variation to set the constant wavelength of the LED, wherein the pre-set current is adapted using a stored error function and the error function determines the temperature of the LED as a function of the actual temperature of the control unit.

13. A computer program product comprising control commands which carry out the method according to claim 1 when executed on a computer.

* * * * *